US009777530B1

(12) United States Patent
Haba et al.

(10) Patent No.: US 9,777,530 B1
(45) Date of Patent: Oct. 3, 2017

(54) SEAMLESS MULTI-PANEL DOOR

(71) Applicant: OVERHEAD DOOR CORPORATION, Lewisville, TX (US)

(72) Inventors: Charles A. Haba, Massillon, OH (US); Dwayne J. Kornish, Navarre, OH (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 14/725,652

(22) Filed: May 29, 2015

(51) Int. Cl.

| | |
|---|---|
| ***E05D 15/16*** | (2006.01) |
| ***E06B 3/44*** | (2006.01) |
| ***E06B 3/48*** | (2006.01) |
| ***E05D 15/24*** | (2006.01) |

(52) U.S. Cl.
CPC ..... *E06B 3/44* (2013.01); *E05D 15/16* (2013.01); *E05D 15/24* (2013.01); *E06B 3/48* (2013.01)

(58) Field of Classification Search
CPC ..... E05D 15/16; E06B 3/485
USPC ..... 160/201, 229.1; 52/235
See application file for complete search history.

(56) References Cited

U.S. PATENT DOCUMENTS 2,374,056 A 4/1945 Watkins
2,928,462 A * 3/1960 Neisewander ..... E06B 3/485 160/229.1
2,931,435 A * 4/1960 Neisewander ..... E06B 3/485 160/229.1
3,221,465 A * 12/1965 McKee ..... E06B 3/485 160/229.1
3,402,457 A * 9/1968 Landow ..... E06B 3/825 160/229.1
4,338,753 A 7/1982 Janke
4,434,593 A 3/1984 Horike et al.
4,635,420 A 1/1987 Batky
4,783,941 A * 11/1988 Loper ..... E04C 2/384 52/235
4,828,004 A * 5/1989 Martinez ..... E06B 3/7001 160/201
4,914,888 A 4/1990 Hanson
5,035,096 A 7/1991 Ohtake et al.
5,155,958 A * 10/1992 Huff ..... E04F 13/0826 52/204.593
5,185,979 A * 2/1993 Azzimonti ..... E04B 2/967 52/235
5,301,484 A * 4/1994 Jansson ..... E04F 13/145 52/122.1
5,339,584 A 8/1994 Ohtake et al.
5,373,672 A 12/1994 Schulz
5,598,667 A * 2/1997 Dykes ..... E06B 3/7001 160/236
5,901,510 A 5/1999 Ellingson
6,006,817 A 12/1999 Stone et al.
(Continued)

*Primary Examiner* — David Purol
(74) *Attorney, Agent, or Firm* — Gardere Wynne Sewell LLP

(57) ABSTRACT

A panel of a sectional door includes a panel frame and a sheet of material that is coupled to the panel frame. The panel frame includes a top frame member, a bottom frame member, a first side frame member and a second side frame member. The frame members include a rear surface and a front surface, and the front surface includes a ledge. The sheet of material is coupled to the front surface such that a bottom edge of the sheet rests on the ledge and a front surface of the sheet is unobstructed by the panel frame.

23 Claims, 6 Drawing Sheets

(56) References Cited

U.S. PATENT DOCUMENTS 6,062,293 A * 5/2000 Berger, Jr. ..... E06B 3/485 160/229.1
6,148,582 A 11/2000 Ellingson
6,378,266 B1 4/2002 Ellingson
6,425,218 B1 * 7/2002 Doyon ..... E04F 13/081 403/295
6,578,619 B2 6/2003 Wright
6,586,085 B1 * 7/2003 Jella ..... B32B 3/26 160/201
D486,241 S 2/2004 Maher
D486,585 S 2/2004 Maher
6,698,145 B2 3/2004 Berger, Jr.
6,708,458 B1 3/2004 Berger, Jr.
D488,234 S 4/2004 Maher
D488,870 S 4/2004 Maher
D490,537 S 5/2004 Maher
6,763,638 B1 7/2004 Berger, Jr.
6,772,814 B2 8/2004 Leist et al.
D498,303 S 11/2004 McGrady
6,837,011 B2 1/2005 Berger, Jr.
D505,495 S 5/2005 Maher
6,915,573 B2 * 7/2005 Mullet ..... C09J 5/00 156/314
6,948,547 B2 9/2005 Maher
D511,842 S 11/2005 Kim
7,107,736 B2 9/2006 Barnard
D538,943 S 3/2007 Maher
D553,255 S 10/2007 Maher
7,299,853 B2 * 11/2007 Brown ..... E06B 3/485 160/201
D561,911 S 2/2008 Maher
D561,912 S 2/2008 Maher
D561,913 S 2/2008 Maher
D561,914 S 2/2008 Maher
D564,668 S 3/2008 Mock et al.
D564,669 S 3/2008 Mock et al.
D564,670 S 3/2008 Mock et al.
D565,194 S 3/2008 Mock et al.
D565,196 S 3/2008 Mock et al.
D565,744 S 4/2008 Mock et al.
7,437,856 B2 10/2008 Berger, Jr.
D582,565 S 12/2008 Colston et al.
D586,475 S 2/2009 Maher
7,766,069 B2 8/2010 Ni et al.
7,770,624 B2 8/2010 Ni et al.
7,857,032 B2 12/2010 Ni et al.
7,954,285 B2 6/2011 Taylor et al.
D647,217 S 10/2011 Richter et al.
8,201,367 B2 6/2012 Barnard et al.
D665,099 S 8/2012 Paxton
D665,100 S 8/2012 Paxton
D665,101 S 8/2012 Paxton
D676,978 S 2/2013 Paxton
D685,109 S 6/2013 Paxton
D687,163 S 7/2013 Paxton et al.
D692,582 S 10/2013 Paxton
8,640,414 B2 2/2014 Reyes, II
8,684,066 B2 4/2014 Ni et al.
D704,351 S 5/2014 Paxton et al.
2002/0179255 A1 12/2002 Leist et al.
2003/0192658 A1 10/2003 Kendall et al.
2005/0194106 A1 * 9/2005 Scales ..... E05D 15/24 160/201
2006/0027342 A1 2/2006 Maher
2006/0254730 A1 11/2006 Wood
2010/0077664 A1 * 4/2010 Stensland ..... E05D 15/242 49/197
2014/0182239 A1 * 7/2014 Bennett ..... E06B 3/66 52/788.1

* cited by examiner

SEAMLESS MULTI-PANEL DOOR

TECHNICAL FIELD

The present invention relates generally to a multi-panel door, and, more particularly, to a multi-panel door having a seamless exterior appearance.

BACKGROUND

Multi-panel doors of the type used for closing a large opening in a building, such as a garage door, have long been manufactured using a plurality of substantially identical panels. The plurality of panels are typically hingedly or pivotally connected together to permit relative hinging movement between adjacent panels when the door is moved between a closed, vertical position, and an open, horizontal position.

Such multi-panel doors are commonly referred to as upward opening sectional doors and often include panels formed of a shell or casing, such as a molded or stamped piece of metal, fiberglass, or plastic, and an insulating core. In some cases, the multi-panel door includes windows positioned within one or more of the panels to allow users to view through a portion of the door. Due to the lightweight shell and core used to form the panels, multi-panel doors often require cumbersome, external framing structures to hold the windows in place. Thus, it is often difficult to create a seamless appearance on a multi-panel door that includes one or more windows. In addition, the windows and framing structures of such doors often provide for a limited viewing area through the door.

SUMMARY

In some embodiments, a multi-panel door includes a plurality of panel frames and a plurality of sheets of material that, when coupled to the panel frames, create an external surface of the door that has a seamless appearance when viewed from a distance. In some embodiments, the multi-panel door includes translucent sheets of material to provide a viewing area that covers a large portion of the door to give the door the appearance of a full, seamless viewing area.

According to a first aspect, there is provided a panel of a sectional door, the panel including a panel frame comprising a top frame member, a bottom frame member, a first side frame member and a second side frame member. The frame members include a rear surface and a front surface with the front surface having a ledge extending therefrom. The panel includes a sheet of material coupled to the front surface such that a bottom edge of the sheet rests on the ledge and a front surface of the sheet is unobstructed by the panel frame.

According to some embodiments, the panel includes an adhesive positioned between the front surface of the panel frame members and the sheet.

In yet other embodiments, the bottom edge of the sheet directly contacts the ledge.

In still other embodiments, the sheet is at least partially translucent.

In other embodiments, the sheet is at least partially opaque.

In yet another embodiment, the sheet is tempered glass.

According to some embodiments, the tempered glass includes flame-polished edges.

In still other embodiments, the sheet is at least partially translucent.

In yet another embodiment, the sheet is polycarbonate.

In other embodiments, the panel frame members are aluminum extrusions.

According to a second aspect, there is provided a multi-panel door having a plurality of panel frames, wherein each panel frame of the plurality of panel frames includes an inward facing surface, an outward facing surface, and a ledge extending from the outward facing surfaces. The multi-panel door includes a plurality of glass panels coupled to the outward facing surfaces of the plurality of panel frames, wherein a lower edge of the plurality of glass panels rests on the ledge.

In yet another embodiment, the ledge extends from the panel outward facing surface at a right angle.

In other embodiments, an outward facing surface of the plurality of glass panels is unobstructed by the plurality of panel frames.

In yet another embodiment, a color of the ledge matches a color of the plurality of glass panels.

According to another embodiment, an adhesive is positioned between the plurality of glass panels and the plurality of panel frames.

In still other embodiments, a double-sided tape positioned between the plurality of glass panels and the plurality of panel frames.

According to a third aspect, there is provided a method of manufacturing a panel of a sectional door. The method includes providing a panel frame comprising an outward facing surface and a ledge that protrudes from the outward facing surface and providing an at least partially translucent sheet comprising an inward facing surface and an outward facing surface. The method further includes coupling the inward facing surface of the at least partially translucent sheet to the outward facing surface of the panel frame so that a bottom edge of the at least partially translucent sheet rests on the ledge and so that an outward facing surface of the at least partially translucent sheet is unobstructed by the panel frame.

According to some embodiments, the method further includes placing an adhesive between the inward facing surface of the at least partially translucent sheet and the outward facing surface of the panel frame.

In yet another embodiment, the method further includes aligning a bottom edge of the at least partially translucent sheet with the ledge to position the at least partially translucent sheet on the panel frame.

In still another embodiment, the method includes coating the ledge so that a color of the ledge substantially matches a color of the at least partially translucent sheet.

In yet another embodiment, the method further includes placing a second sheet adjacent to the at least partially translucent sheet on the panel frame.

For a more complete understanding of the present invention, including additional features, objects and advantages thereof, reference is now made to the following detailed description taken in conjunction with the drawings, in which:

DETAILED DESCRIPTION

Figure 1:
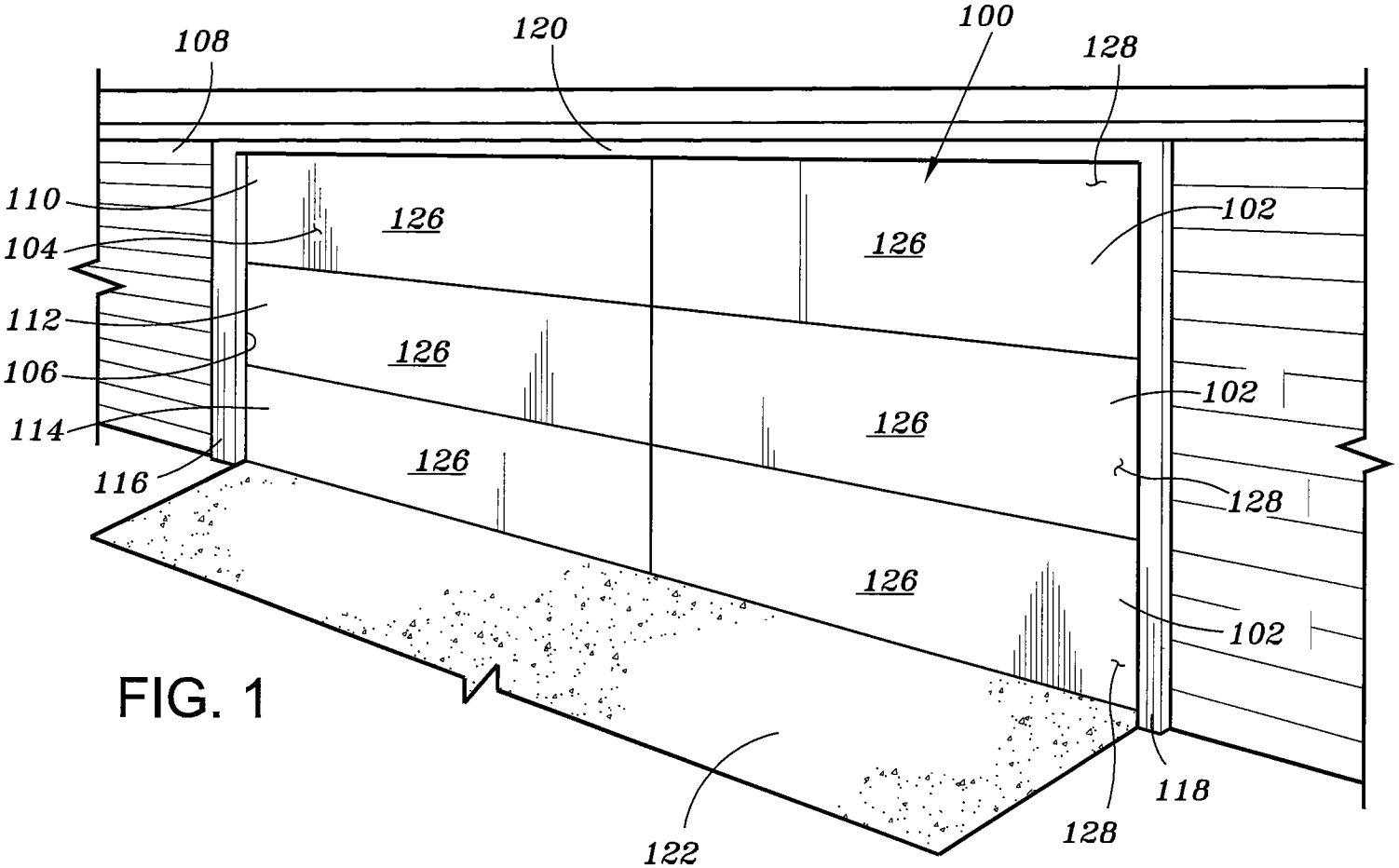
FIG. 1 is a perspective view of an embodiment of a multi-panel door having three panels in accordance with this disclosure.

In the description which follows, like parts are marked throughout the specification and drawings with the same reference numerals. The drawings may not be to scale and certain features may be shown exaggerated in scale or in somewhat schematic form in the interest of clarity and conciseness.

FIG. 1 is a perspective view of an embodiment of a multi-panel, upward-acting, sectional door 100 having a seamless exterior appearance. The multi-panel door 100 includes a plurality of panels 102 that form a front face 104 of the door 100 and enclose an opening 106 in a building 108 or other structure. In the embodiment illustrated in FIG. 1, for example, the door 100 includes three panels 102, namely, a top panel 110, an intermediate panel 112 and a bottom panel 114, that enclose an opening 106 defined by two jambs 116 and 118, a header 120 and a driveway 122. In some embodiments, the panels 102 are hingedly connected and mounted on conventional track and rollers (not shown) within the building to enable movement of the door 100 between the vertical position shown in FIG. 1, and a horizontal (i.e., overhead) position. In other embodiments, the door 100 may include any number of panels 102 and may be located in any suitable opening 106.

Figure 2:
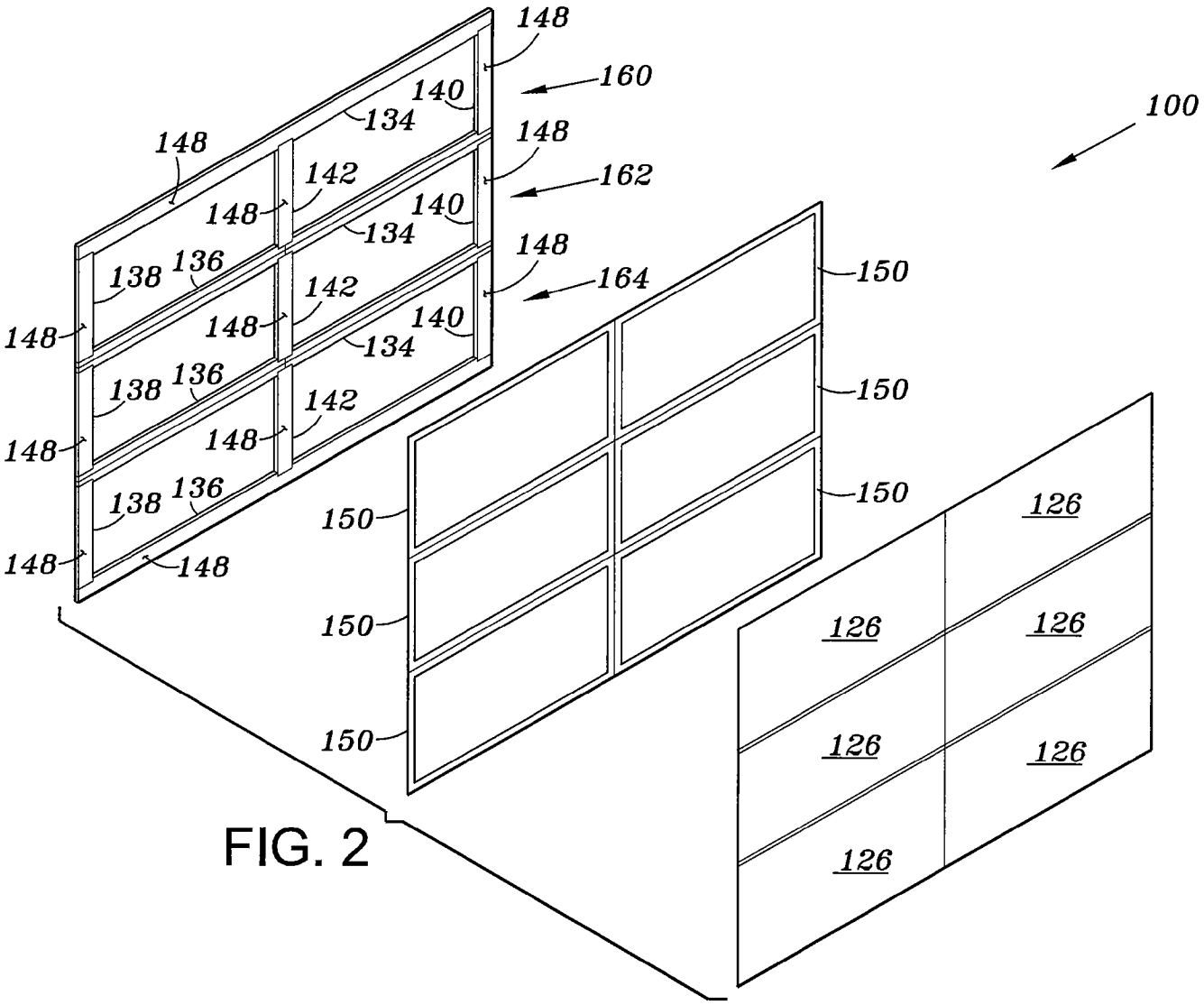
FIG. 2 is a partial exploded view of the multi-panel door of FIG. 1.
Figure 3:
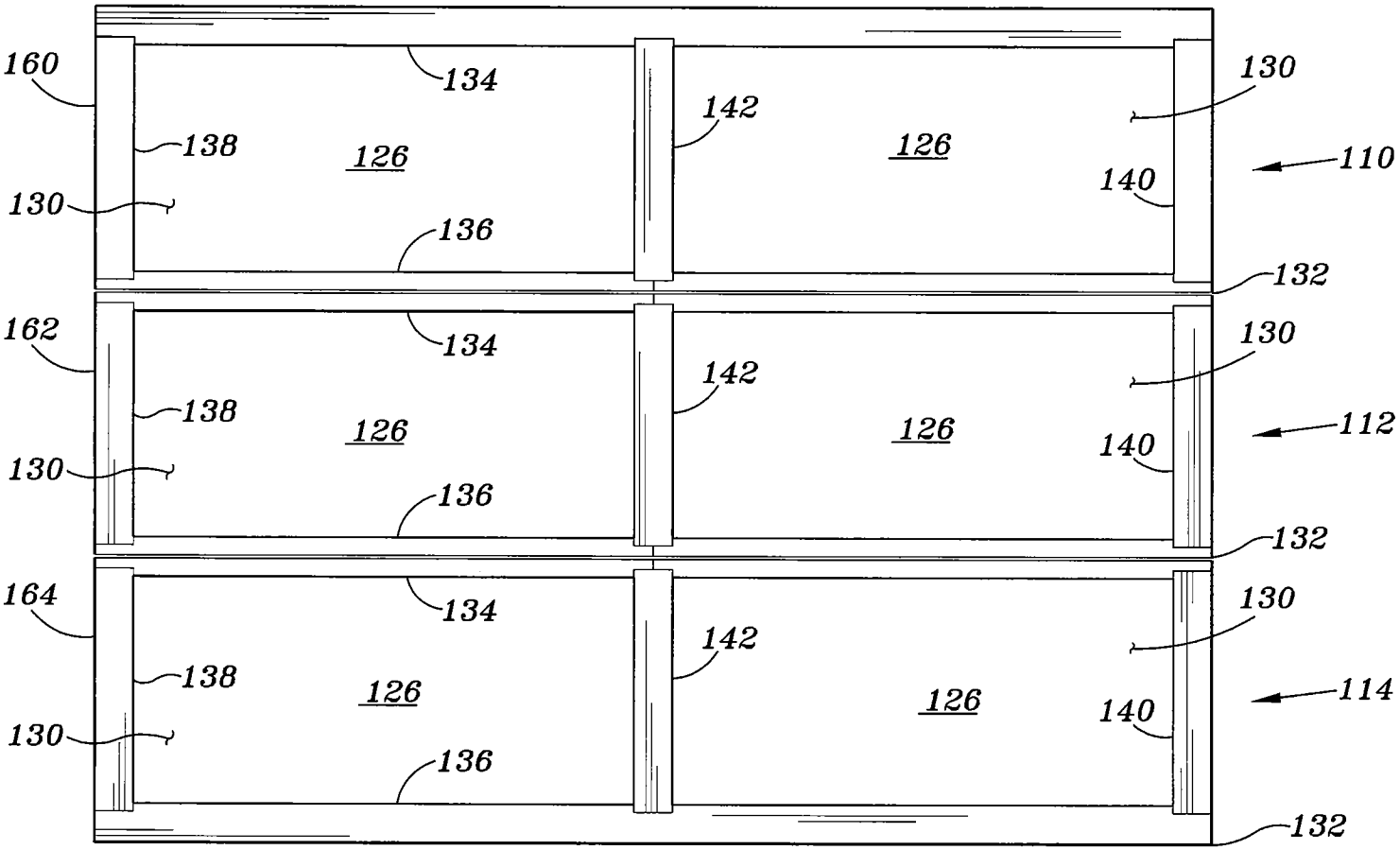
FIG. 3 is a rear view of the multi-panel door of FIG. 1.

In FIGS. 1-3, each panel 102 of the door 100 includes a frame 160, 162 or 164 (see FIGS. 2 and 3) and at least one sheet 126 of material coupled to the frame 160, 162 or 164. The sheets 126 of material are coupled to the panel frame 160, 162 or 164 such that an outer surface 128 of each sheet 126 is unobstructed by the panel frames 160, 162 or 164. In some embodiments, the unobstructed sheets 126 give the multi-panel door 100 a seamless exterior appearance when the door 100 is in the closed position, as will be described in more detail below.

The sheets 126 of material may be made of any suitable material and may be opaque, translucent, semi-translucent, transparent, semi-transparent or a combination of any of the foregoing. For example, in some embodiments the sheets 126 are made of semi-translucent black, white, bronze or mirror silver glass. In other embodiments, the sheets 126 are made of an opaque metal material. In yet other embodiments, the sheets 126 are made of tempered glass that has flame-polished edges to prevent chipping or cracking. In some embodiments, the sheets 126 are partially translucent, partially opaque or a combination of partially translucent and partially opaque.

The sheets 126 may also have any suitable thickness. In some embodiments, for example, the sheets 126 are ⅛ inch thick. In other embodiments, the sheets 126 are thicker or thinner than ⅛ inch. For example, in some embodiments the sheets 126 are a glass material that is ¼ inch thick. In some embodiments, the sheets 126 have a height and width that are substantially equal to the height and width of the corresponding panel frame 160, 162 or 164. In other embodiments, multiple sheets 126 couple to each of the panel frames 160, 162 or 164 and the sheets 126 have a combined height and width that is substantially equal to the height and width of the corresponding panel frame 160, 162 or 164.

The sheets 126 may also have any suitable color. For example, in some embodiments the sheets 126 have an anodized bronze or anodized brown color. In yet other embodiments, the sheets 126 have a semi-transparent black, white or mirror silver color.

As discussed above, in some embodiments the sheets 126 are coupled to the frames 160, 162 or 164 such that the frames 160, 162 and 164 do not obstruct an outer surface 128 of the sheets 126. As will be described in more detail below, in some embodiments, a ledge 132 (see FIGS. 3-7) of each panel frame 160, 162 and 164 is positioned below the sheets 126 and is partially exposed on the front face 104 of the door 100. As such, in some embodiments the ledge 132 of each panel frame 160, 162 and 164 is painted, coated, or otherwise configured to have a color that is similar to the coloring of the sheets 126. Thus, in some embodiments the entire front face 104 of the multi-panel door 100 has a substantially uniform color to give the door 100 a seamless appearance.

Referring now to FIG. 2, in some embodiments each panel frame 160, 162 and 164 includes an upper frame member 134, a lower frame member 136, a first side member 138 and a second side member 140. In some embodiments, the upper frame member 134, the lower frame member 136, the first side member 138 and the second side member 140 are metal extrusions that are coupled to form a rectangular panel frame 160, 162 and 164, as illustrated in the embodiment of FIG. 2. In some embodiments, the panel frame 160, 162 or 164 also includes one or more intermediate frame members 142. For example, in the embodiment illustrated in FIG. 2 each frame 160, 162 and 164 includes an intermediate frame member 142 that couples the upper frame member 134 to the lower frame member 136 and divides the frames 160, 162 and 164 into two equal sections. While the panel frames 160, 162 and 164 illustrated in FIG. 2 are rectangular in shape, the panel frames 160, 162 and 164 may be any suitable shape in other embodiments.

Figure 4:
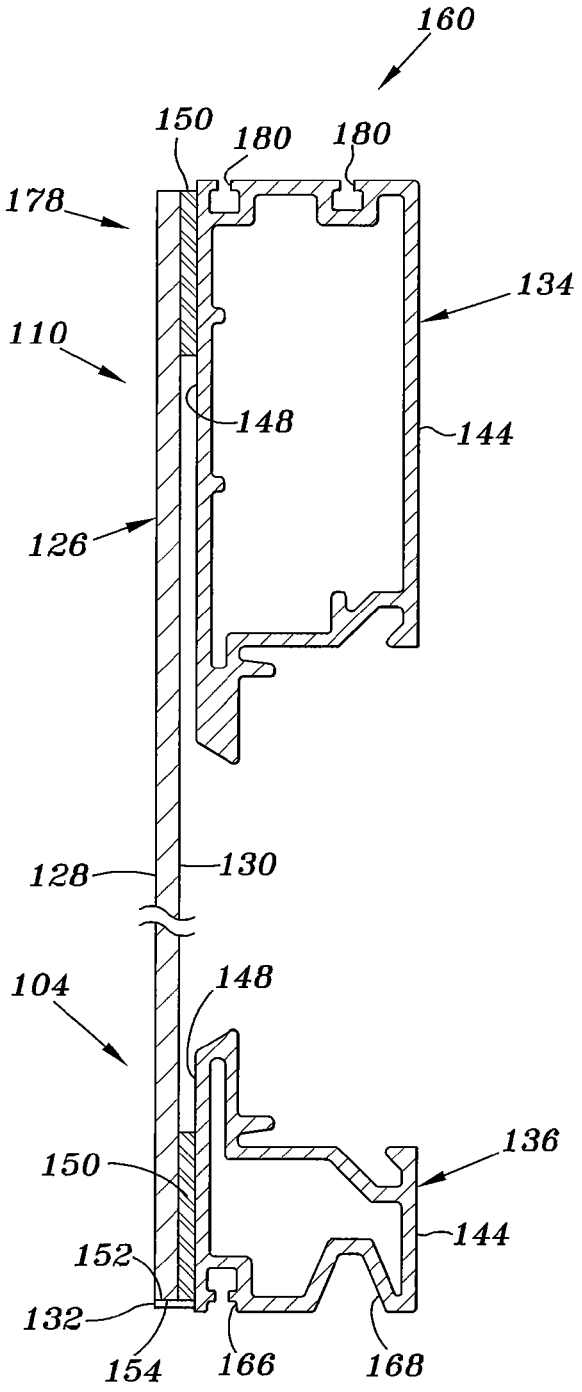
FIG. 4 is a cross section view of the top panel of the multi-panel door of FIG. 1.
Figure 5:
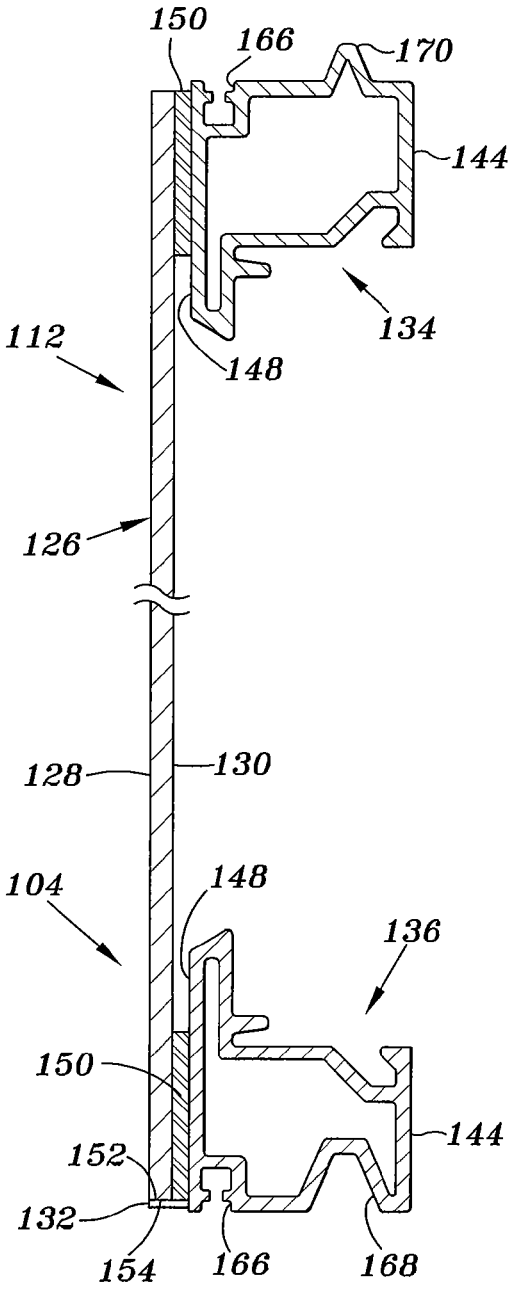
FIG. 5 is a cross section view of the intermediate panel of the multi-panel door of FIG. 1.
Figure 6:
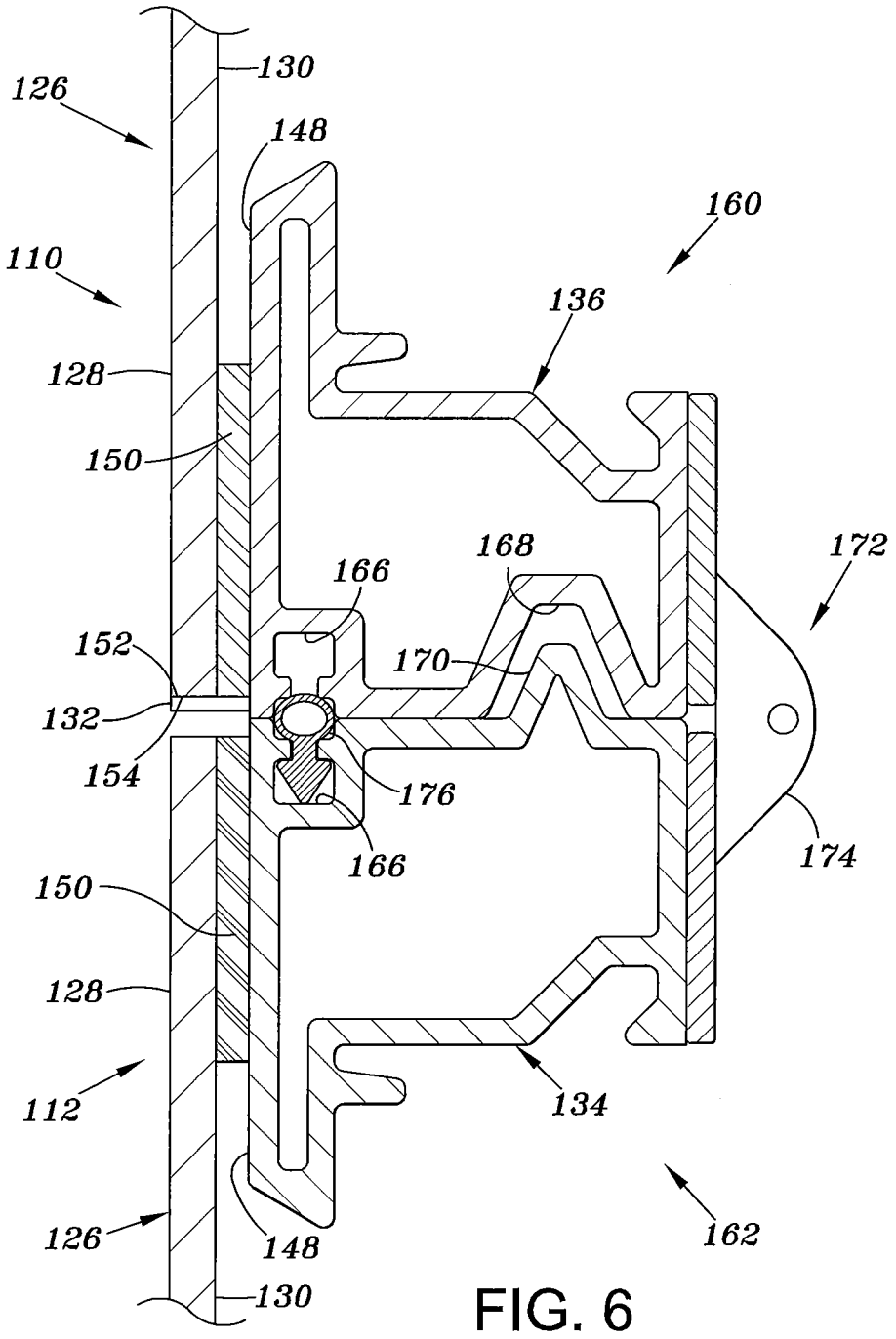
FIG. 6 is a cross section view of a hinged connection between the top panel and the intermediate panel of FIG. 1.

Each member 134, 136, 138, 140 and 142 of the panel frames 160, 162 and 164 includes an inner surface 144 (see FIGS. 4-6) that faces an interior portion of the space enclosed by the door 100, such as the interior portion of a garage, and an exterior surface 148 that faces away from the space enclosed by the door 100. The lower frame member 136 of each frame 160, 162 and 164 includes the ledge 132 (FIGS. 3-7) that extends from the exterior surface 148 of the lower frame member 136. In some embodiments, the exterior surfaces 148 of the frame members 134, 136, 138, 140 and 142 of each panel frame 160, 162 and 164 are substantially co-planar when the door 100 is in the vertical position, as illustrated in FIG. 1, with the exception of the ledges 132 that protrude from the exterior surfaces 148, as best illustrated in FIGS. 4, 5 and 6. In some embodiments, the sheets 126 are substantially planar pieces of material that are also substantially coplanar when adhered to the frame members 134, 136, 138, 140 and 142 of each panel frame 160, 162 and 164.

Referring again to FIG. 2, a coupling mechanism 150 is positioned on the exterior surfaces 148 of the frame members 134, 136, 138, 140 and 142 to adhere the sheets 126 to the exterior surfaces 148 of the frame members 134, 136, 138, 140 and 142. In some embodiments, the coupling mechanism 150 is a layer of adhesive, a layer of double-sided tape or some other coupling object. In some embodiments, the coupling mechanism 150 is a double-sided tape, such as 4991 VHB tape made by 3M Company of Maplewood, Minnesota. In other embodiments, the coupling mechanism 150 is an adhesive, such as Adseal 4549 silicone based adhesive made by AdChem Corporation of Riverhead, N.Y. The coupling mechanism 150 may be any suitable adhesive, double-sided tape or other coupling mechanism in other embodiments.

In some embodiments, the coupling mechanism 150 is positioned on the outer surfaces 128 of the frame members 134, 136, 138, 140 and 142 and on a top surface 152 (FIGS. 4-7) of the ledges 132. In yet other embodiments, the coupling mechanism 150 is not positioned on the ledges 132 but is only positioned on the outer surfaces 128 of the frame members 134, 136, 138, 140 and 142.

In the embodiment illustrated in FIG. 2, two sheets 126 of material are coupled to each panel frame 160, 162 and 164 by way of the coupling mechanism 150. In other embodiments, any number of sheets 126 can be coupled to each panel frame 160, 162 and 164 by way of the coupling mechanism 150.

FIG. 3 is a rear view of the door of FIG. 1. In the embodiment illustrated in FIG. 3, the positioning of the panel frames 160, 162 and 164 behind the sheets 126 of material is illustrated. In some embodiments, a majority of the inner surface 130 of the sheets 126 is unobstructed by the panel frames 160, 162 and 164 so that the door 100 has a principally transparent or translucent appearance when the sheets 126 are made of a transparent or translucent material. In some embodiments, for example, more than seventy percent of the inner surface 130 of the sheets 126 is unobstructed by the panel frames 160, 162 or 164. In other embodiments, more than sixty percent of the inner surface 130 of the sheets 126 is unobstructed by the panel frames 160, 162 or 164. In yet other embodiments, more than fifty percent of the inner surface 130 of the sheets 126 is unobstructed by the panel frames 160, 162 or 164.

FIGS. 4 and 5 illustrate cross-section views of the top and intermediate panels 110 and 112, respectively, of the door 100 of FIG. 1. The bottom panel 114 is a mirror image of the top panel 110 and thus is not individually illustrated herein in the interest of conciseness. Referring specifically to FIG. 4, in some embodiments the top panel frame 160 includes a large, or "heavy-duty," upper frame member 134 and a small, or "light duty," lower frame member 136. In some embodiments, the upper frame member 134 is substantially rectangular in shape and generally has a cross-section profile configured to provide structural strength to a top portion 178 of the top panel frame 160.

The upper frame member 134 includes an exterior surface 148 that is substantially planar and provides a surface to which the coupling mechanism 150 can be adhered. In some embodiments, the coupling mechanism 150 covers only a portion of the exterior surface 148 of the upper frame member 134, as illustrated in FIG. 4. In other embodiments, the coupling mechanism 150 covers all or substantially all of the exterior surface 148 of the upper frame member 134.

In some embodiments, the upper frame member 134 also includes one or more openings 180 to receive an end cap (not shown) or other device to protect the upper frame member 134.

The lower frame member 136 also includes a planar exterior surface 148 to which a coupling mechanism 150 can be adhered. The planar, exterior surface 148 faces an exterior of the door and is substantially parallel to the exterior surface 148 of the upper frame member 134. The lower frame member 136 also includes a sealing member receptacle 166 and a groove 168 that helps to seal the upper panel 110 to the intermediate panel 112, as discussed in more detail below in connection with FIG. 6.

As described above, the lower frame member 136 of each of the panel frames 160, 162 and 164 includes a ledge 132 to support at least part of the weight of the sheet(s) 126. The ledge 132 extends from the exterior surface 148 of the lower frame member 136 and includes a top surface 152 that supports the sheet 126. In some embodiments, the top surface 152 directly contacts a lower edge 154 of the sheet 126. In other embodiments, the top surface 152 contacts another element, such as an adhesive or double-sided tape (not shown), that is placed between the sheet 126 and the ledge 132.

In some embodiments, the ledge 132 extends perpendicularly from the exterior surface 148 of the lower frame member 136 a distance that corresponds to the combined thickness of the sheet 126 and the coupling mechanism 150. As such, in some embodiments the ledge 132 and the outer surface 128 of the sheet 126 are substantially aligned when the sheet 126 is coupled to the respective panel frame 160, 162 or 164. As discussed above, in some embodiments the ledge 132 of each panel frame 160, 162 and 164 is visible at the front face 104 of the door 100 when the door 100 is in the fully closed position, as illustrated in FIG. 1.

Referring now to FIG. 5, in some embodiments the intermediate frame member 142 includes a small, or "light duty," upper frame member 134 and a small, or "light duty," lower frame member 136. As discussed above, each of the upper and lower frame members 134 and 136 include a planar exterior surface 148 that provides a surface to which the coupling member 150 is adhered. The upper and lower frame members 134 and 136 each include a sealing member receptacle 166 used to seal adjacent panels 110, 112 and 114. In addition, the upper frame member 134 includes a tongue protrusion 170 while the lower frame member 136 includes a groove 168 that are each used to further seal adjacent panels 110, 112 and 114, as described in more detail below.

The lower frame member 136 also includes a ledge 132 that protrudes from the exterior surface 148 to support the sheet 126. In some embodiments, the ledge 132 protrudes perpendicularly from the exterior surface 148 and supports the lower edge 154 of the sheet 126 on the top surface 152 of the ledge 132.

FIG. 6 illustrates a hinged connection 172 between the top panel 110 and the intermediate panel 112 of FIG. 1. A hinged connection between the intermediate panel 112 and the bottom panel 114 may be substantially similar to the hinged connection 172. In addition, a hinged connection between adjacent intermediate panels 112 (in an embodiment in which the door 100 includes multiple intermediate panels 112) may also be substantially similar to the hinged connection 172.

In some embodiments, the top panel frame 160 is hingedly coupled to the intermediate panel frame 162 by one or more hinge members 174. In some embodiments, the frame members 134 and 136 include sealing features to prevent water, air, insects or another elements from passing between the top and intermediate panels 110 and 112 when the door 100 is in the closed position. In some embodiments, for example, the lower frame member 136 of the top panel 110 includes a groove 168 and the upper frame member 134 of the intermediate panel frame 162 includes a corresponding tongue protrusion 170 configured to reside within the groove 168 when the door 100 is in the closed position. In some embodiments, the interaction between the groove 168 and the tongue protrusion 170 when the door 100 is in the closed position substantially prevents entry of water and light between the top and intermediate panels 110 and 112.

In addition, in some embodiments one or more of the lower frame member 136 of the top panel 110 and the upper frame member 134 of the intermediate panel 112 includes a resilient sealing member 176 located in the respective sealing member receptacle 166. In some embodiments, the resilient sealing member 176 is compressed when the door 100 is in the closed position to further seal the top and intermediate panels 110 and 112 to each other.

Figure 7:
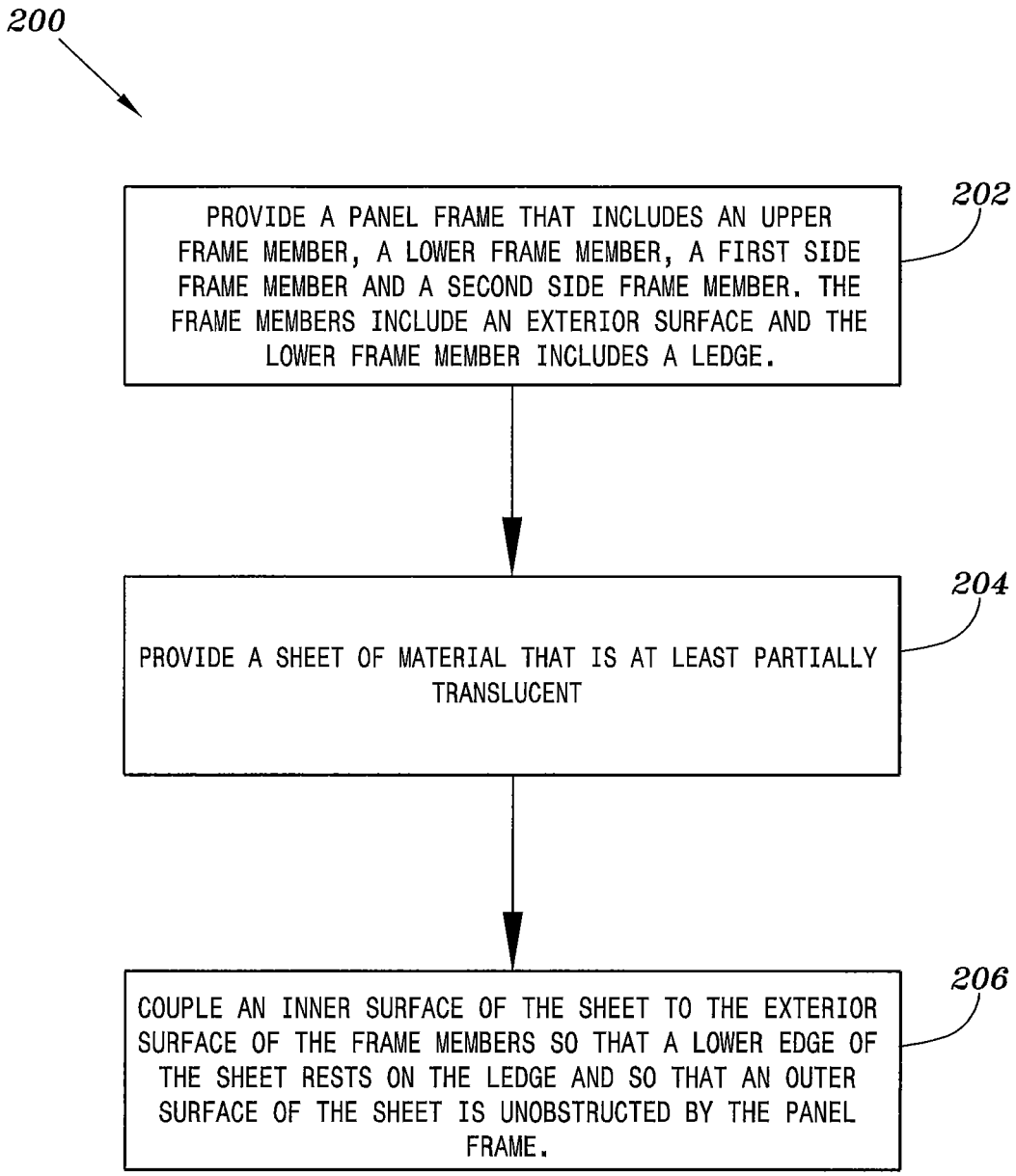
FIG. 7 is a flow diagram illustrating a method of manufacturing the multi-panel door of FIG. 1.

FIG. 7 illustrates an embodiment of a method 200 for manufacturing a panel 110, 112 or 114 for use on a seamless, multi-panel door 100. In some embodiments, the method 200 begins and a panel frame 160, 162 or 164 that includes an upper frame member 134, a lower frame member 136, a first side frame member 138, a second side frame member 140, and one or more intermediate frame members 142 is provided, as illustrated at block 202. The frame members 134, 136, 138, 140 and 142 include an exterior surface 148 and the lower frame member 136 includes a ledge 132 that protrudes from the exterior surface 148 of the lower frame member 136.

A sheet 126 of material is also provided, as illustrated at block 204. In some embodiments, the sheet 126 is at least partially translucent and has an outer surface 128 and an inner surface 130.

The inner surface 130 of the sheet 126 is then coupled to the exterior surface 148 of the frame members 134, 136, 138, 140 and 142 so that a lower edge 154 of the sheet 126 rests on the ledge 132 and so that an outer surface 128 of the sheet 126 is unobstructed by the panel frame, as illustrated at block 206.

In some embodiments, the method 200 also includes placing a coupling mechanism 150, such as an adhesive material or double-sided tape, on the exterior surface 148 of each of the frame members 134, 136, 138, 140 and 142 to adhere the sheet 126 to the frame members 134, 136, 138, 140 and 142.

In other embodiments, a worker then places a lower edge 154 of the sheet 126 onto the ledge 132 of the lower frame member 136 to align the sheet 126 with the panel frame 160, 162 or 164. In some embodiments, the worker then presses the sheet 126 onto the coupling mechanism 150 and, in some embodiments, clamps the sheet 126 to the panel frame 160, 162 or 164 until the coupling mechanism 150 has cured and hardened to a suitable strength, often referred to as the "green strength." In some embodiments, additional sheets 126 are attached to the panel frame 160, 162 or 164 in like manner.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "outer" and "inner," "upper" and "lower," "first" and "second," "internal" and "external," "above" and "below" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Although specific embodiments have been described in detail, those skilled in the art will also recognize that various substitutions and modifications may be made without departing from the scope and spirit of the appended claims.

What is claimed is:

1. An upward acting, multi-panel door for enclosing an opening, the door comprising:

a plurality of panel frames rotatably coupled together and movable between an open position to enable passage through the opening, and a closed position to prevent passage through the opening, each panel frame comprising a top frame member, a bottom frame member, a first side frame member and a second side frame member, wherein the frame members comprise a rear surface and a front surface, wherein the front surface of the bottom frame member comprises a ledge, wherein the ledge extends outwardly from the bottom frame member of the panel frame a first distance, wherein the ledge has a top planar surface and a bottom planar surface, wherein the ledge extends outwardly from the bottom frame member of the panel frame at a position spaced apart from a bottom edge of the bottom frame member, forming a first gap between the bottom planar surface of the ledge and the bottom edge of the bottom frame member;

a hinge rotatably coupling the bottom frame member of a first panel frame of the plurality of panel frames to the top frame member of an adjacent panel frame of the plurality of panel frames, wherein a second gap is formed between the top frame member of the adjacent panel frame and the bottom planar surface of the ledge, wherein the second gap is greater than or equal to the first gap; and a sheet of material having a rear surface and an opposed front surface, the rear surface coupled to the front surface of the panel frame such that a bottom edge of the sheet rests on the top planar surface of the ledge, wherein the front surface of the sheet is a second distance from the front surface of the panel frame, the first distance being less than or equal to the second distance, wherein no portion of the plurality of panel frames contacts the front surface of the sheet.

2. The door of claim 1, further comprising a coupling mechanism having an adhesive positioned between the planar front surface of at least one of the plurality of panel frames and the sheet, and wherein the first distance comprises a combined thickness of the sheet and the coupling mechanism.

3. The door of claim 1, wherein the coupling mechanism consists of an adhesive layer bonded to at least one of the plurality of panel frames and to the sheet of material, and wherein the coupling mechanism and the ledge comprise the only coupling of the sheet of material to the panel frame.

4. The door of claim 1, wherein the sheet is at least partially translucent.

5. The door of claim 1, wherein the sheet is at least partially opaque.

6. The door of claim 1, wherein the sheet is tempered glass.

7. The door of claim 6, wherein the tempered glass includes flame-polished edges.

8. The door of claim 1, wherein the sheet is polycarbonate.

9. The door of claim 1, wherein the panel frame members are aluminum extrusions, roll formed steel, or drawn square tubes.

10. An upward acting, multi-panel door, the door comprising:

a plurality of panel frames, wherein each panel frame of the plurality of panel frames includes an inward facing surface, a planar outward facing surface, and a ledge extending from the planar outward facing surface a first distance, the ledge having a top surface and a bottom surface and being spaced apart a first ledge distance from a lower distal end of the panel frame; and a plurality of glass panels each having a front surface and a planar rear surface, wherein the planar rear surface of each of the plurality of glass panels is coupled to the planar outward facing surfaces of the plurality of panel frames, wherein a lower edge of the plurality of glass panels rests on the top surface of the ledge, wherein each front surface of each glass panel is a second distance from the outward facing surfaces of the plurality of panel frames to which the glass panel is coupled, the first distance being less than or equal to the second distance, wherein the planar outward facing surface is planar with the exception of the ledge, wherein each panel frame further includes a top frame member comprising:

a first sealing member receptacle configured to receive a resilient sealing member and positioned nearer to the planar outward facing surface than to the inward facing surface; and a tongue protrusion positioned nearer to the inward facing surface than to the planar outward facing surface, wherein each panel frame further includes a bottom frame member providing the lower distal end of the panel frame and comprising:

a second sealing member receptacle configured to receive the resilient sealing member of the top frame member of an adjacent panel frame inside the second sealing member receptacle when the door is in a closed position and biased toward the planar outward facing surface; and a groove configured to receive the tongue protrusion of the top frame member of the adjacent panel frame inside the groove when the door is in the closed position and biased toward the inward facing surface; and a hinged connection hingedly coupling the bottom frame member of a first panel frame of the plurality of panel frames to the top frame member of the adjacent panel frame of the plurality of panel frames, wherein the first ledge distance separates the bottom surface of the ledge from the lower distal end of the panel frame, wherein the ledge is spaced apart from and does not contact the adjacent panel frame.

11. The door of claim 10, wherein the ledge extends from the panel outward facing surface at a right angle.

12. The door of claim 10, wherein an outward facing surface of the plurality of glass panels is unobstructed.

13. The door of claim 10, wherein a color of the ledge matches a color of the plurality of glass panels.

14. The door of claim 10, further comprising an adhesive positioned between the plurality of glass panels and the plurality of panel frames.

15. The door claim 10, further comprising a double-sided tape positioned between the plurality of glass panels and the plurality of panel frames.

16. A method of manufacturing a panel of a sectional door, the method comprising:

providing a panel frame comprising a planar outward facing surface and a ledge that protrudes from the outward facing surface, wherein the planar outward facing surface is planar with the exception of the ledge, wherein the ledge is spaced apart a first ledge distance from a bottom edge of the panel frame;

providing an at least partially translucent sheet comprising a planar inward facing surface and an outward facing surface;

coupling the planar inward facing surface of the at least partially translucent sheet to the planar outward facing surface of the panel frame so that a bottom edge of the at least partially translucent sheet rests on the ledge, whereby no portion of the panel frame contacts the outward facing surface of the at least partially translucent sheet, and wherein the at least partially translucent sheet is spaced apart by the ledge from the bottom edge of the panel frame;

forming a first sealing member receptacle in the panel frame configured to receive a resilient sealing member and positioned nearer to the planar outward facing surface than to the inward facing surface;

forming a tongue protrusion in the panel frame positioned nearer to the inward facing surface than to the planar outward facing surface, wherein the resilient sealing member is configured to be received by second sealing member of an adjacent panel frame, wherein the tongue protrusion is configured to be received by a groove of the adjacent panel frame; and providing a hinged connection configured to hingedly couple the panel frame to the adjacent panel frame, wherein the first ledge distance separates the ledge from the bottom edge of the panel frame, wherein the ledge is spaced apart from and does not contact the adjacent panel frame.

17. The method of claim 16, wherein the coupling the inward facing surface of the at least one partially translucent sheet to the outward facing surface of the of the panel frame comprises placing a coupling mechanism comprising an adhesive between the inward facing surface of the at least partially translucent sheet and the outward facing surface of the panel frame.

18. The method of claim 16, further comprising aligning a bottom edge of the at least partially translucent sheet with the ledge to position the at least partially translucent sheet on the panel frame.

19. The method of claim 16, further comprising coating the ledge so that a color of the ledge substantially matches a color of the at least partially translucent sheet.

20. The method of claim 16, further comprising placing a second sheet adjacent to the at least partially translucent sheet on the panel frame.

21. An upward acting, multi-panel door, the door comprising:

a panel frame comprising:

a top frame member comprising:

a first sealing member receptacle configured to receive a resilient sealing member, a tongue protrusion;

a bottom frame member comprising:

a second sealing member receptacle configured to receive the resilient sealing member of the top frame member of an adjacent panel frame inside the second sealing member receptacle when the door is in a closed position; and a groove configured to receive the tongue protrusion of the top frame member of the adjacent panel frame inside the groove when the door is in the closed position, wherein the front surface of the top frame member and the front surface of the bottom frame member each is planar;

a ledge extending outwardly from the front surface of the bottom frame member of the panel frame at a position spaced apart from the bottom edge of the bottom frame member;

a sheet of material disposed on the panel frame and contacting the ledge; and a coupling mechanism securing the sheet of material to the panel frame, the coupling mechanism comprising an adhesive sandwiched between the panel frame and the sheet.

22. The upward acting, multi-panel door according to claim 21, wherein the panel frame comprises an inner surface and an opposed outer surface, the adhesive positioned only on the outer surface of the panel frame.

23. The upward acting, multi-panel door according to claim 21, wherein a front surface of the sheet of material is an outermost surface of the door.

* * * * *